United States Patent [19]

Zimmerman

[11] 4,332,594

[45] Jun. 1, 1982

[54] FUELS FOR INTERNAL COMBUSTION ENGINES

[75] Inventor: David M. Zimmerman, Detroit, Mich.

[73] Assignee: Chrysler Corporation, Highland Park, Mich.

[21] Appl. No.: 253,493

[22] Filed: Apr. 13, 1981

Related U.S. Application Data

[63] Continuation-in-part of Ser. No. 114,250, Jan. 22, 1980, abandoned.

[51] Int. Cl.[3] ..... C10L 1/18

[52] U.S. Cl. ..... 44/53; 44/76; 44/77

[58] Field of Search ..... 44/53, 76, 77; 252/DIG. 1, 407

[56] References Cited

U.S. PATENT DOCUMENTS

| | | | |
|---|---|---|---|
| 1,495,094 | 5/1924 | Morgan | 44/53 |
| 1,501,383 | 7/1924 | White | 44/53 |
| 3,233,986 | 2/1966 | Morehouse | 44/76 |
| 3,527,581 | 9/1970 | Brownawell et al. | 44/51 |
| 3,764,282 | 10/1973 | Furlong et al. | 44/76 |
| 4,272,254 | 6/1981 | Minezaki | 44/76 |

*Primary Examiner*—Winston A. Douglas
*Assistant Examiner*—J. V. Howard
*Attorney, Agent, or Firm*—Newtson and Dundas

[57] ABSTRACT

An oxygenated hydrocarbon based fuel for use in internal combustion engines is composed by volume of alcohol (40–80%), ketone (0–30%) ether (15–40%), a dimethyl siloxane (0.01–1.0%) a surfactant (0.25–1.0%) and a fuel-soluble corrosion inhibitor (0.02–0.1%). The resulting fuel has excellent storage life and performance characteristics superior to gasoline.

11 Claims, 5 Drawing Figures

BHP VS AIR/FUEL MASS RATIO

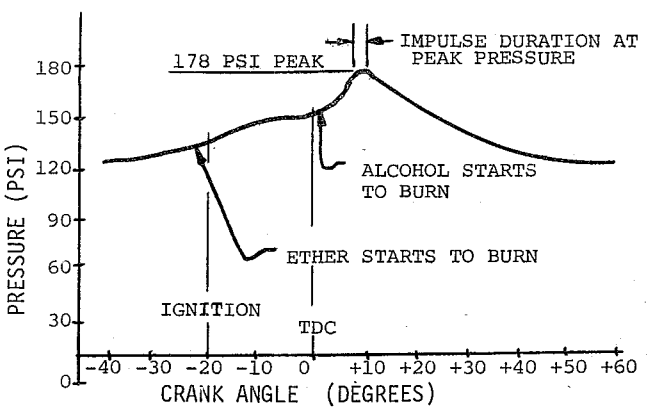
FIGURE 1. PRESSURE VS CRANK ANGLE TRACE ENGINE OPERATING ON ALCOHOL/ETHER AT AIR/FUEL RATIO 13:1
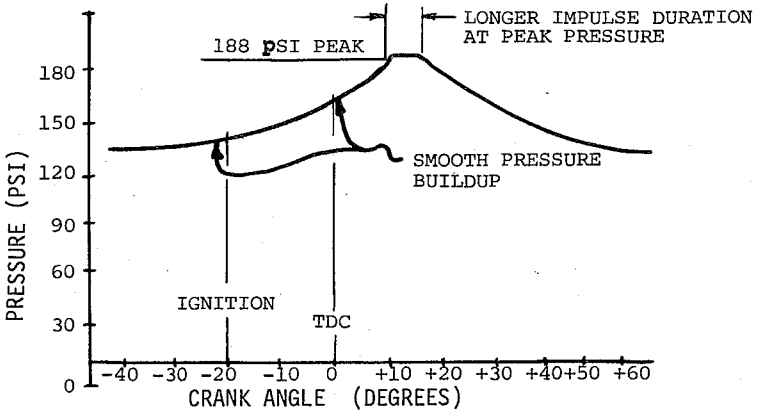
FIGURE 4. PRESSURE VS CRANK ANGLE TRACE ENGINE OPERATING ON ALCOHOL/ETHER WITH SILOXANE, EMULSIFIER, AND CORROSION INHIBITOR AT AIR/FUEL RATIO 13:1
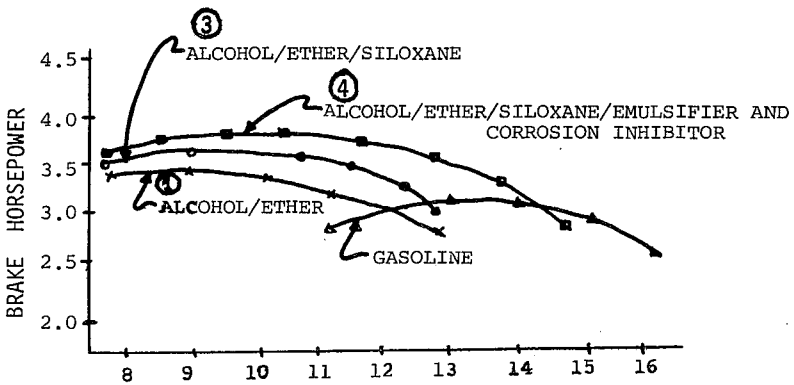
FIGURE 3. BHP VS AIR/FUEL MASS RATIO

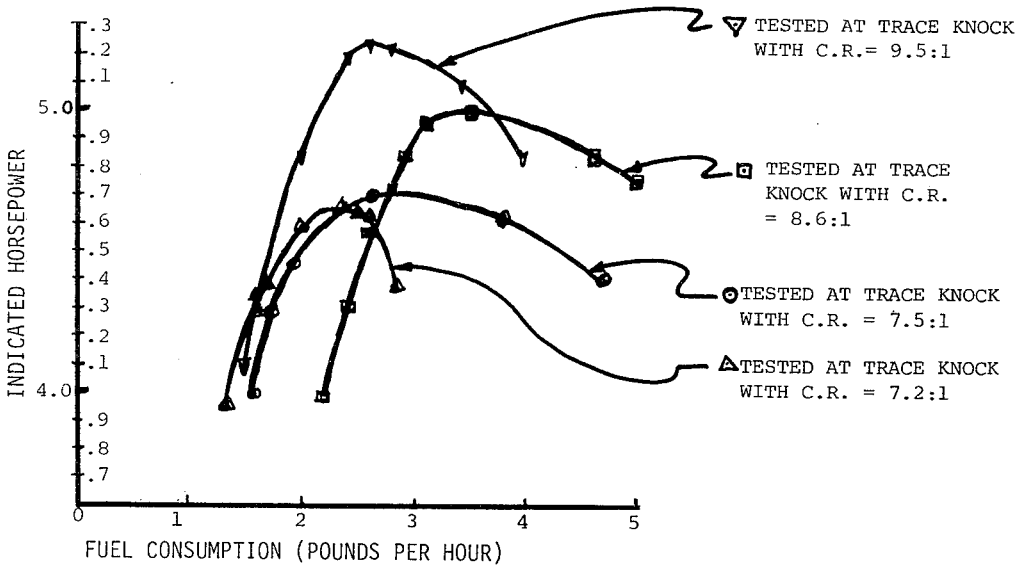
FIGURE 2. POWER VS FUEL USED
SYMBOLS:
▼ = BUTYL ALCOHOL/ETHYL ALCOHOL WITH DIAMYL ETHER
⊙ = BUTYL ALCOHOL/ETHYL ALCOHOL WITH DIETHYL ETHER
⊡ = ETHYL ALCOHOL WITH DIETHYL ETHER
△ = GASOLINE
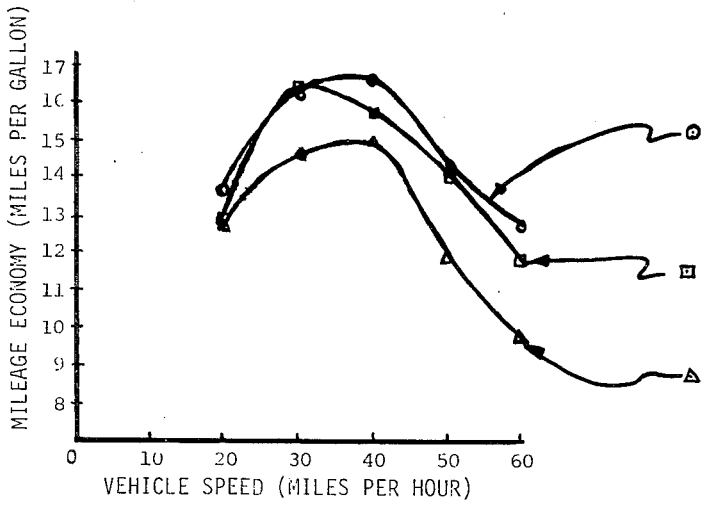
FIGURE 5. STEADY STATES

FUELS FOR INTERNAL COMBUSTION ENGINES

CROSS REFERENCE TO RELATED APPLICATION

This application is a continuation-in-part of U.S. patent application Ser. No. 114,250 filed Jan. 22, 1980 and entitled Oxygenated Hydrocarbon Fuels for Internal Combustion Engines, now abandoned.

This invention relates to improved compositions of oxygenated hydrocarbon based fuels especially suited for use in internal combustion engines and particularly to such fuels which are principally composed of blends of alcohol and ether components. A ketone component may be used in place of some of the alcohol component.

In the search for a substitute for the liquid fossil fuel-gasoline, research and experimentation has sometimes been conducted using oxygenated hydrocarbons (alcohols) as the main fuel components. Adherents to the use of methyl alcohol point to the ease with which it may be manufactured and then combusted in an internal combustion engine. However, at its max power fuel/air ratio, methyl alcohol is consumed in an amount which is more than double that of gasoline. This fact has spurred the search for a liquid fuel which is more rate consistent with gasoline.

Some researchers have explored the possibility of using the oxygenated hydrocarbon-ethyl alcohol as a fuel for internal combustion engines but have encountered problems with fuel distribution in the intake manifold and combustion chambers of spark ignition engines. Moreover, since ethyl alcohol does not have the same vaporization properties as gasoline, it does not flow uniformly to the cylinders of most mass manufactured multicylinder engines. Various schemes have been advanced to overcome this problem but all lead to changes in the construction and layout of the commonly used spark ignition engine.

It has also been proposed to modify the vaporization properties of the ethyl alcohol by addition of a more volatile liquid such as ether to the ethyl alcohol base. However a serious deficiency occurs with such a formulation. When mixed together, for example, in the proportion of 75% by volume ethyl alcohol to 25% ether, and then immediately used in a spark ignition engine, combustion is excellent and, in fact, more power is produced than available with straight run gasolines; but when mixed together and then stored for a time, the ether evaporates and the fuel cannot provide good combustion.

Numerous patents attempt to solve this problem. For instance, U.S. Pat. No. 1,338,982 (1920) teaches that by adding water to an alcohol/ether mix, the ether is held in permanent combination with the alcohol. It has since been recognized that water inside an engine initiates severe rusting among the engine members and soon damages the ability of the engine to perform.

U.S. Pat. No. 1,377,992 (1921) proposes an ethyl alcohol/ether mix to which is added a small proportion of one or more aliphatic amines (preferably mono or dimethylamine). The amine fixes the ether to the alcohol. Since the advent of emissions testing in the middle 1960's it has been found that nitrogenous compounds (such as the amines) dissociate during combustion forming oxides of nitrogen, a toxic pollutant.

An additional serious deficiency connected with the heretofore disclosed alcohol-ether based fuels results from the different flame velocities of the ether and the alcohol. When combusted in the fuel lean region, i.e., less fuel than theoretically needed to combine with the air present in the combustion chamber, the ether burns earlier than the alcohol forming a discontinuous flame front which causes a loss in power and vehicle (engine) surging. This is illustrated in the accompanying diagram, FIG. 1, which is an oscilliscope trace of the pressure buildup with time (Crank Angle Degrees) of an engine operating with just such a lean fuel to air mass ratio so as to conserve fuel. It can be readily seen that the ether (diethyl ether) combusts before the main fuel component which was ethyl alcohol.

Thus, if the promise of an effective liquid substitute fuel is to be fulfilled utilizing oxygenated hydrocarbons (alcohol and ether)—then the two aforementioned deficiencies must be overcome, viz—ether evaporation and flame velocity differences.

It is therefore an object of this invention to provide a composition which may be employed in the place of gasoline as a fuel for internal combustion engines.

A further object of this invention to provide a liquid oxygenated hydrocarbon-ether based fuel in which ether evaporation is substantially reduced.

Another object of this invention is to provide an oxygenated hydrocarbon based fuel (alcohol and ether) in which a combustion bond is effected between the two main fuel components.

It is yet another object of this invention to provide a fuel containing an alternative group of ethers in combination with an oxygenated hydrocarbon base—which ethers retain a vapor changing characteristic with the alcohol, but which do not evaporate away during the distribution, storage, or use cycle of the fuel.

The foregoing objects, as well as other advantages, are obtained by the oxygenated hydrocarbon fuel of the invention which comprises by volume 40 to 80% alcohol, 0 to 30% ketone, 15 to 40% ether, 0.01 to 1.0% liquid siloxane, 0.025 to 1.0% emulsifier or surfactant, and 0.02 to 0.10% fuel-soluble corrosion inhibitor. The liquid siloxane, the surfactant and the corrosion inhibitor are additives which may be used in various combinations with the alcohol-ether fuel base as illustrated by the test results shown in the accompanying charts or diagrams, FIGS. 1, 2, 3, 4 and 5, and further explained in the description of the invention to follow.

The term "alcohol" as used herein means an aliphatic primary alcohol, that is an alcohol in which the hydroxyl group is united to a primary carbon atom, having up to about eight carbon atoms. Examples of such alcohols useful in this invention includes, methyl, ethyl, propyl, butyl, amyl, hexyl and octyl alcohols. A blend of any two or more of such alcohols is also encompassed by the term alcohol.

Many of the alcohols useful in the fuel of this invention are produced by means of a fermentation process from three basic types of agricultural raw materials namely, saccharin, starchy and cellulosic materials. Generally such processes also yield a ketone material and such a mixture of alcohol and ketone is useful in the fuel composition of this invention. For example, one of the products of the butyl alcohol fermentation of carbohydrates is acetone and a preferred fuel composition of this invention comprises on a volume basis about 45% butanol, 21% acetone, 8% ethanol, 24% diethyl ether, 1% siloxane and 1% of a nonionic surfactant. In addition to acetone, other useful ketones for use in this invention include methyl ethyl ketone, ethyl ketone and methyl n-propyl ketone.

Dynamometer engine tests were performed in a laboratory using a Coordinated Fuel Research (CFR) engine coupled to a dynamometer. By changing the carburetor setting and the dynamometer controls, performance mapping (power per unit of fuel consumption) was carried out. This type of engine (CFR) is very useful for alternative fuel research because different fuels may be flowed into the powerplant to determine combustive properties as compared to a reference laboratory gasoline.

For the alcohol test series, several different proportions of ethyl alcohol to diethyl ether within the range of 40 to 80% alcohol to 15 to 40% ether (by volume) were mixed and immediately tested versus gasoline. It was found that at a proportion of 75% by volume of ethyl alcohol to 25% of diethyl ether, consistent cold starting is demonstrated and excellent power and performance is available. FIG. 2 is a graph of the performance comparison of the 75/25 alcohol/ether base fuel to that of laboratory gasoline.

Following the reference gasoline and the ethyl alcohol runs, additional tests were performed using a blend of primary alcohols instead of the ethyl alcohol alone. The fuels for this next series consisted of:

(1) N-Butyl Alcohol (40% by volume, Ethyl Alcohol (35%), Diethyl Ether (25%)

(2) N-Butyl Alcohol (40% by volume), Ethyl Alcohol (35%), Diamyl Ether (25%)

As can be seen in FIG. 2, it was discovered that fuel #1 caused incipient (trace) knock in the CFR engine at a compression ratio of 7.5 to 1. Even so, the fuel consumption of this fuel was substantially less than could be obtained by the use of ethyl alcohol alone. By way of explanation to those not knowledgeable in the engine art, operation of the CFR engine at trace knock provides the maximum power obtainable with a particular fuel without incurring significant increases in toxic pollutants (principally the oxides of nitrogen).

Fuel #2 (the same blend of primary alcohols with diamyl ether instead of diethyl ether) had a much higher compression ratio capability (9.5 to 1) than fuel #1. This extra advantage enabled fuel 190 2 to provide 12% higher indicated horsepower than the reference gasoline (Indolene) at slightly higher fuel consumption rates. If used in a standard multi-cylinder engine this would translate into substantially the same fuel economy as gasoline.

To confirm this discovery, namely that the use of a blend of primary alcohols instead of a single alcohol would improve fuel economy to the point that it equalled gasoline, a 4000 pound gross vehicle weight (GVW) test car was prepared for road trials. The test vehicle was outfitted with a second fuel tank so that the reference gasoline could be evaluated against the alcohol fuels on the road and the driver could switch from one fuel to the other at will.

Vehicle road performance with Fuels #1 and #2 was good to excellent. To quantify such performance, vehicle trials were arranged on a chassis dynamometer equipped with an emissions analyzer. Concurrent runs were accomplished with gasoline and the alcohol fuels, driving the car at speeds from twenty (20) through sixty (60) miles per hour. The constant in these tests was the current EPA (Environmental Protection Agency) standard for exhaust NOx production. The results of steady state operation are shown in FIG. 5 where speed (miles per hour) is plotted against fuel economy for each of the three fuels. From the curves it is clear that insofar as steady highway speeds are concerned both ethanol and the butyl alcohol fuel blend are more fuel economical than gasoline at the present EPA, NOx standard (without catalytic converter). The butanol fuel blend has greater fuel economy than the ethanol fuel over most highway speeds and is, therefore, the preferred fuel overall.

Further dynamometer tests were conducted with the test vehicle according to the Federal Test Procedures (HCVS-74) and the results are charted in Table 1. This procedure is the EPA urban traffic profile which is used to certify automobile performance as to fuel economy and emissions levels. From these tests, it can be seen that the butanol fuel blend significantly improves fuel economy over ethanol fuel and is substantially equal to gasoline mileage economy.

It is believed that transients (changes in fuel demand) of urban traffic are responsible for the reduction in the mileage economy of the ethanol fuel.

TABLE I

FTP RESULTS (HCVS-74)

| FUEL | FUEL ECONOMY (miles per gallon) |
|---|---|
| Reference Gasoline (Indolene) | 13.24 |
| Ethyl Alcohol/Di-Ethyl Ether 75%/25% volume | 9.88 |
| N-Butyl Alcohol/Ethyl Alcohol with Di-Ethyl Ether 40%/35%/25% volume | 12.66 |

It was further discovered that certain fluid additives (dimethyl siloxane, octylphenoxypoly ethanol and a class of oxygenated hydrocarbon corrosion inhibitor) will substantially reduce the disappearance rate of the ether component. The results are presented in Table 2.

The disappearance (evaporation) tests were conducted by mixing different additives to the 75/25 by volume alcohol/ether base fuel and establishing the loss in weight over several time periods—up to 150 hours. The control or reference in these tests was the 75/25 alcohol/ether base fuel itself.

TABLE 2

EFFECT OF ADDITIVES UPON ETHER DISAPPEARANCE

| FUEL NO. (FIG. 3) | COMPOSITION | PERCENT ETHER DISAPPEARANCE WITH TIME 24 hrs. | 48 hrs. | 72 hrs. | 96 hrs. | 120 hrs. | 150 hrs. |
|---|---|---|---|---|---|---|---|
| 1 | ethyl alcohol/ diethyl ether | 18 | 32 | 42 | 50 | 56 | 60 |
| 2 | ethyl alcohol/ diethyl ether plus 100 ppm liquid siloxane polymer (150 centistokes viscosity) | 10 | 19 | 27 | 34 | 40 | 45 |
| 3 | ethyl alcohol/ diethyl ether plus 100 ppm liquid siloxane polymer (0.6 centistokes viscosity) | 1.0 | 1.5 | 2.0 | 2.5 | 3.0 | 3.0 |
| 4 | fuel No. 3 plus 1000 ppm emulsifier plus | | | | | | |

TABLE 2-continued

| EFFECT OF ADDITIVES UPON ETHER DISAPPEARANCE | | | | | | | |
|---|---|---|---|---|---|---|---|
| FUEL NO. (FIG. 3) | COMPOSITION | PERCENT ETHER DISAPPEARANCE WITH TIME | | | | | |
| | | 24 hrs. | 48 hrs. | 72 hrs. | 96 hrs. | 120 hrs. | 150 hrs. |
| | 250 ppm corrosion inhibitor | 0.25 | 0.48 | 0.68 | 0.80 | 0.91 | 1.0 |

It is quite evident from Table 2 that the addition of a small amount of liquid siloxane polymer reduces the evaporation of the ether, and that the most substantial reduction occurs when the viscosity of this additive is tailored to approximately that of the main fuel components, as illustrated by Fuel No. 3. The particular liquid siloxane polymer employed in the fuels of Table 2 was a dimethyl siloxane polymer sold by Dow Corning Corporation under the trademark Dow Corning 200 Fluid.

Fuel No. 4 of Table 2 shows that a further reduction in ether evaporation is obtained by the addition to the alcohol/ether/siloxane blend, Fuel No. 3, of an emulsifier or surfactant and a corrosion inhibitor. The particular surfactant used in these tests was an octylphenoxypoly ethanol product of GAF Corporation identified by the trademark IGEPAL CA-630, but other compounds of the nonionic class surfactants comprising mixes of phenol and ethylene oxide may be used with comparable effects. The particular corrosion inhibitor was a fuel-soluble product of E. I. duPont de Nemours and Company known as DCI-6A corrosion inhibitor, but other similar compositions may be efficiently employed.

In addition, it has been discovered from more extensive power tests that the additives in the fuels of Table 2 boosted the brake horsepower output of the test engine. A series of runs were performed by changing the carburetor setting and taking readings of the maximum brake horsepower available for each particular setting. The mass of air per unit of fuel was determined by exhaust analysis using a group of emissions analyzers. Four runs were conducted, one for laboratory gasoline and one for each of the fuels identified as No. 1, No. 3 and No. 4 in Table 2. The results were then graphed as shown in the drawing, FIG. 3.

It is believed that the liquid siloxane polymer, in addition to its evaporative emission reduction capability, acts to reduce friction between piston and bore by providing lubricative sliding of the piston rings upon the cylinder wall.

It should be particularly noted from the performance of the No. 4 fuel, FIG. 3, that the addition of the nonionic surfactant (IGEPAL CA-630) and the corrosion inhibitor (DCI-6A) has a special power boosting effect in the fuel lean region.

Included in the instrumentation of the power tests of FIG. 3, was a high speed camera attached to an oscilloscope with a vertical trace of combustion chamber pressure and a horizontal trace of crank angle degrees. The drawing FIG. 1, is a copy of a photograph taken in the fuel lean region of the alcohol/ether Fuel No. 1 combination of FIG. 3. The drawing FIG. 4 is a copy of a photograph taken while using ethyl alcohol/diethyl ether/dimethyl siloxane/octylphenoxy polyethanol corrosion inhibitor in the concentrations shown for Fuel No. 4 of Table 2 and at an Air to Fuel Ratio of 13:1.

It is believed that the surfactant and the corrosion inhibitor form a bond between the fuel elements (alcohol and ether) which carries through into combustion and thus brings about a higher combustion pressure, as well as a longer high pressure interval resulting in higher output power—particularly in the fuel lean region (see FIGS. 3 and 4).

In the fuel compositions of this invention excellent results are obtained by including in the fuel about 0.5% by volume of an additive comprising about, based on the total volume of additive, 0.37% by volume of surfactant, 0.03% by volume of siloxane and 0.10% by volume of corrosion inhibitor.

In the course of the experimentation it had been found that a real need exists for an alternative volatile liquid which could increase vapor pressure of the alcohol when mixed with it so that the combination would possess similar vaporization properties to gasoline in normal stock internal combustion engines, but which would not evaporate so readily as diethyl ether. I found such a liquid to be diamyl ether $(C_5H_{11})_2O$. Disappearance rate tests comparing the ethers in the oxygenated hydrocarbon base (in this case it was ethyl alcohol) are shown in Table 3 for 75% alcohol/25% ether mixtures.

Other ethers which can be employed in this invention are of the general formula ROR and include the simple ethers wherein the R groups are alike and mixed ethers in which the R groups are different. Useful ethers are those in which the R groups are alkyls having up to eight carbon atoms. Representative of such ethers are dimethyl ether, diethyl ether, methyl ethyl ether, ethyl t-butyl ether, i-propyl ether, methyl propyl ether, n-butyl ether, s-butyl ether and i-amyl ether. Preferred ethers for use in the fuel composition of this invention are diethyl ether and diamyl ether.

TABLE 3

| COMPARISON OF ETHERS - DISAPPEARANCE RATE TESTS | | | | | | |
|---|---|---|---|---|---|---|
| | PERCENT ETHER DISAPPEARANCE WITH TIME | | | | | |
| FUEL | 24 hrs. | 48 hrs. | 72 hrs. | 96 hrs. | 120 hrs. | 150 hrs. |
| ethyl alcohol and diethyl ether | 18 | 32 | 42 | 50 | 56 | 60 |
| ethyl alcohol and diamyl ether | 2.0 | 3.4 | 4.4 | 5.1 | 5.6 | 6.0 |

RESTATEMENT OF FINDINGS

To facilitate oxygenated hydrocarbon usage as a substitute fuel for gasoline, ether (40 to 15% by volume) may be employed as a volatizer. Experimentally a proportion of 75% by volume of alcohol to 25% of an ether (preferably commercially available diethyl ether) furnishes almost identical vaporization and flow properties to gasoline. In addition, cold starts are consistent and power and performance surpass straight run gasolines. As a means of improving storage capability, a silicone based polymer in liquid form may be added to the fuel components in additive concentrations within the range of 0.01% by volume to an upper limit of 1.0% practically speaking. The presently preferred embodiment is a dimethyl siloxane polymer known by the trademark Dow Corning DC 200 at a kinematic viscosity of 0.6 centistokes, although other liquid forms of silicone polymer may be employed in a viscosity range of 0.4 to 0.8 centistokes with comparable results. One effect of this additive is to reduce the evaporation of the ether down to manageable levels considering the lengths of time required to process the fuel, transport and store it at the distribution level, and, finally at service stations. Another effect of this additive is to increase the brake horswpower output of an internal combustion engine in comparison with either gasoline or a straight alcohol/ether mixture.

Further reductions in ether evaporation can be attained by the addition of the alcohol/ether mixture of a surfactant within the range of 0.025 to 1.0% by volume, or a fuel-soluble corrosion inhibitor within the range of 0.02 to 0.1% by volume, or a combination of a surfactant and fuel-soluble corrosion inhibitor.

Best results to-date have been obtained by the use of a nonionic surfactant which is a blend of phenols and ethylene oxide, or a condensation product of octylphenol and ethylene oxide, or a condensate of $C_{5-15}$ alkyl phenol and $C_{2-5}$ oxide. The presently preferred corrosion inhibitor is an oxylated hydrocarbon.

When operating an engine with fuel lean ratios to reduce fuel consumption, ether combusts before the alcohol and resultant power is reduced. This combustion gap can be eliminated by the addition to the alcohol/ether fuel or the combination of a surfactant (comprising phenols and ethylene oxide) and a fuel-soluble corrosion inhibitor in mole ratios from 3:1 to 15:1. This combination appears to bond the ether to the alcohol through the combustion phase, improving the combustion and increasing the power output. As indicated above, the preferred ethers for use in this invention due to their commercial availability and price are diethyl ether and diamyl ether. It has been found that diamyl ether may be substituted for the commercially available diethyl ether in a liquid oxygenated hydrocarbon base (such as ethyl alcohol) with significant reduction in ether evaporation. This substitution provides the same vaporization changing characteristic needed to improve oxygenated hydrocarbon alcohol properties and may be used in the approximately same proportions with the alcohol base as demonstrated herein with diethyl ether. Efficient utilization is available in the ranges of 70 to 80% by volume of oxygenated hydrocarbon to 30−20% of the diamyl ether. The storage and performance characteristics of this alcohol/diamyl ether fuel are further enhanced by the additives described herein.

It has been surprisingly discovered that a blend of alcohols when used in the fuel compositions of this invention would provide significantly increased fuel economy over a single alcohol component. This surprising result was true even if the alcohol component contained a ketone which is sometimes present in commercial alcohols. A preferred blend of two alcohols is from about $\frac{1}{3}$ to $\frac{2}{3}$ of high molecular weight alcohol to lower molecular weight alcohol. As with a single alcohol component, the fuel composition employing an alcohol blend provides superior fuel characteristics when containing the various additives set forth above, i.e., siloxane, surfactant and corrosion inhibitor. The following fuel composition has given excellent performance in a Chrylser V/8 internal combustion engine:

| FUEL COMPOSITION (by volume) | | |
|---|---|---|
| n-butyl alcohol | | 40% |
| ethyl alcohol | | 35% |
| diethyl ether | | 24.5% |
| surfactant | GAP's IGEPAL-630 | 0.36% |
| siloxane | Dow Chemical DC-200 | 0.26% |
| corrosion inhibitor | DuPont's DCI-6A | 0.08% |

What is claimed is:

1. An oxygenated hydrocarbon based fuel comprising a primary aliphatic alcohol, an ether of the formula ROR wherein R is an alkyl group containing up to about 8 carbon atoms, and a liquid silicone polymer.

2. An oxygenated hydrocarbon based fuel according to claim 1 comprising 40 to 80% alcohol and 15 to 40% ether by volume.

3. An oxygenated hydrocarbon based fuel according to claim 1 wherein said liquid silicone polymer is dimethyl siloxane.

4. An oxygenated hydrocarbon based fuel according to claim 3 wherein the concentration range of said liquid silicone polymer is 0.01 to 1.0% by volume.

5. An oxygenated hydrocarbon based fuel according to claim 4 further comprising a surfactant in a concentration range of 0.025 to 1.0% by volume.

6. An oxygenated hydrocarbon based fuel according to claim 1 further comprising a surfactant which is a condensation product of phenols and ethylene oxide or propylene oxide.

7. An oxygenated hydrocarbon based fuel according to claim 6 wherein said surfactant is a condensate of $C_{5-15}$ alkyl phenol and ethylene oxide.

8. An oxygenated hydrocarbon based fuel according to claims 1 or 5 further comprising a fuel-soluble corrosion inhibitor in a concentration range of about 0.02 to 0.1% by volume.

9. An oxygenated hydrocarbon based fuel according to claim 8 wherein said corrosion inhibitor is an oxylated hydrocarbon.

10. An oxygenated hydrocarbon based fuel according to claim 1 wherein said alcohol component is a blend of butyl- and ethyl alcohols and wherein said ether is selected from the group consisting of diethyl-and diamyl ethers.

11. An oxygenated hydrocarbon based fuel comprising about 40 to 80% by volume of a primary aliphatic alcohol having up to 8 carbon atoms, from about 15 to 40% by volume of an ether of the formula ROR wherein R is an alkyl group containing up to about 8 carbon atoms, from about 0.01 to 1.0% by volume of a liquid silicone polymer, from about 0.025% to 1.0% by volume of a surfactant and from about 0.02 to 0.1% of a fuel-soluble corrosion inhibitor.

* * * * *